United States Patent [19]

Buttner

[11] 4,175,222

[45] Nov. 20, 1979

[54] PUSHBUTTON SWITCH

[76] Inventor: Horace J. Buttner, 1501 Palos Verdes Dr., North, Harbor City, Calif. 90710

[21] Appl. No.: 873,030

[22] Filed: Jan. 27, 1978

Related U.S. Application Data

[63] Continuation of Ser. No. 720,319, Sep. 3, 1976, abandoned.

[51] Int. Cl.[2] ..... H01H 3/12

[52] U.S. Cl. ..... 200/159 R; 200/16 B; 200/160

[58] Field of Search ..... 200/16 A, 64, 153 J, 200/159 R, 160, 280, 281, 16 B, 16 C, 159 A

[56] References Cited

U.S. PATENT DOCUMENTS

| | | | |
|---|---|---|---|
| 2,845,608 | 7/1958 | Short | 200/16 A X |
| 2,930,859 | 3/1960 | Nolden et al. | 200/16 A |
| 3,223,813 | 12/1965 | Lewandowsky | 200/159 R |
| 3,586,810 | 6/1971 | Brown | 200/159 R X |
| 3,694,603 | 9/1972 | Congeluere | 200/153 J |
| 3,790,734 | 2/1974 | Raab et al. | 200/153 T X |
| 3,829,633 | 8/1974 | Smith et al. | 200/16 A |
| 3,940,585 | 2/1976 | Schaad | 200/159 R |

*Primary Examiner*—Willis Little

*Attorney, Agent, or Firm*—Pollock, Vande Sande & Priddy

[57] ABSTRACT

A small, versatile electrical switch suitable for the control of low current electrical devices includes a bridging contact, in the form of a thimble, telescoped over and axially slidable on a guide stud disposed between spaced coined conductor ends which are engaged by flanges of the thimble in a retracted position. A floating sleeve having radial latch dogs is rotated by sequential push operations into and out of latching engagement with the ends of circumferentially spaced holding ribs in a surrounding housing establish projected and retracted positions for the thimble. A coil spring normally biases the thimble and sleeve to a retracted position in which position the flanges of the thimble contact the coined conductor ends. A push operation rotates the sleeve latching the sleeve and thimble in a projected position wherein the flanges are out of contact with the coined conductor ends. The next push operation rotates the sleeve, disengaging the latch dogs and allowing the coil spring to position the thimble and sleeve in its retracted position at the same time making firm electrical contact between the flanges of the thimble and the coined conductor ends under the influence of the spring.

10 Claims, 8 Drawing Figures

FIG. 5
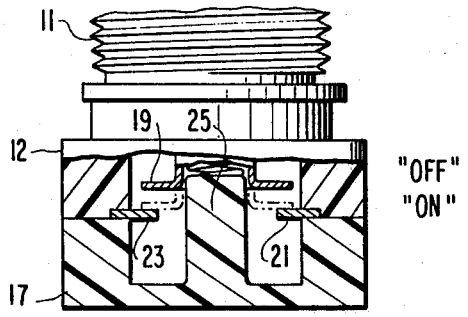
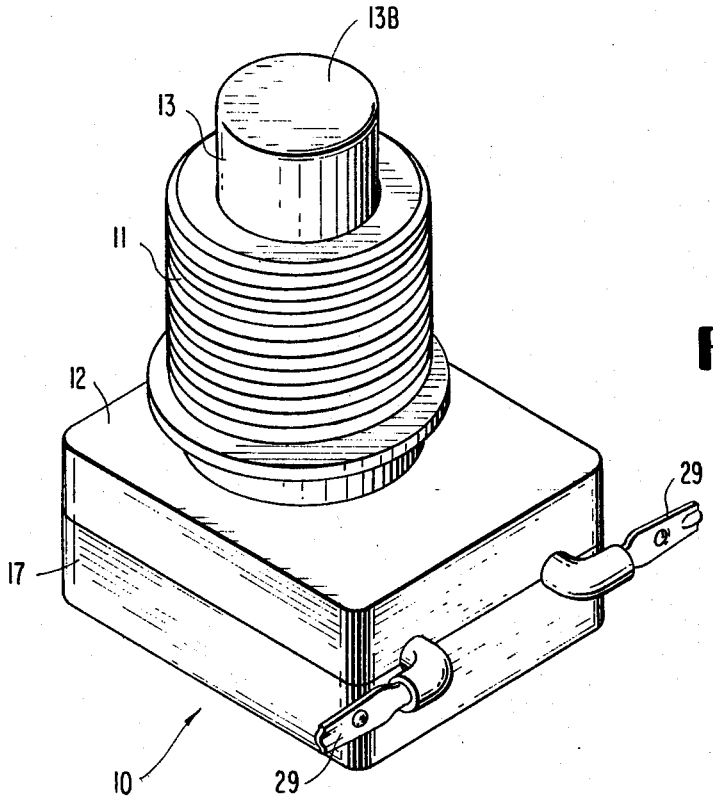
FIG. 6

PUSHBUTTON SWITCH

This is a continuation of application Ser. No. 720,319, filed Sept. 3, 1976 now abandoned.

FIELD OF THE INVENTION

The present invention relates to a versatile pushbutton switch.

BACKGROUND OF THE INVENTION

The Congelliere et al U.S. Pat. No. 3,694,603, discloses a "Push-Push Switch With Improved Alternate Make and Break Latching Mechanism." The present invention is an improvement of the switch therein disclosed which is capable of being configured as a push-push switch, a momentary on or momentary off switch with only slight modifications to essentially the same components.

The Congelliere et al switch, one of whose inventors is the present applicant, has been found to have several disadvantages which are overcome by the switch of the present invention. The referred-to switch is a push-push type switch which alternately makes and breaks an electrical circuit. However, as those skilled in the art are aware, other switch functions are also desirable, such as momentary on and momentary off. While the prior art discloses structures which can be employed for these switching functions, it would be desirable if the referred-to switch were also capable of these functions. I have found, that by slight modification of the referred-to switch, it can be made to perform the momentary on, or momentary off functions, or the push-push function.

Another aspect of the referred-to switch which has proven to be troublesome is the connection between the switch blades or contacts (switch blades C as illustrated in the patent) and the conductors (such as conductor 42) which serve to connect the switch to the device being controlled. If this connection fails, and such failure has been noticed in use, the switching arrangement becomes inoperative and therefore requires service.

In the referred-to switch an electrical connection is made between a pair of normally non-contacting conductors, by a moveable contact under the influence of a manually operable plunger. A ratchet mechanism allows alternate operation of the plunger to maintain the contact in retracted or projected positions with the cooperation of a coil spring which urges the contact into its retracted position. The contact bridges the electrical conductors in its retracted position. For a push-push switch, this allows the possibility of inadvertent making of the connection if a plunger is inadvertently depressed. For some uses, for example, a battery operated flashlight, this can be a serious disadvantage if the plunger remains inadvertently depressed for a substantial period of time, for in this condition the battery may be inadvertently depleted.

Finally, the highly stressed flexible spring blade contacts employed in the switch are subject to stress failure under use.

SUMMARY OF THE INVENTION

The present invention overcomes the disadvantages abovementioned as well as other disadvantages of the referred-to switch.

A pushbutton switch is capable of electrically connecting a pair of conductors each having coined ends retained in the switch. The switch has a housing including a barrel having an axis and a head portion generally transverse to the axis. A cover is secured to the head with the coined ends secured in non-contacting relation between cover and head. A contact is moveable along the axis for bridging the coined ends. A sleeve mounts the contact for axial movement and a plunger, mounted in the barrel, engages the sleeve for projecting the sleeve and contact against the action of a coil spring biasing the contact, sleeve and plunger to a retracted position in which the contact bridges the coined ends. A ratchet mechanism, for rotary indexing of the sleeve, serves to latch the contact and sleeve, on alternate successive operations of the plunger, in a projected position wherein the contact is out of engagement with the coined ends.

The switch obviates the electrical connections internal of the switch and thus eliminates problems associated with such connections. By providing the contact to bridge the conductors under influence of the spring positive connection is achieved and, at the same time, inadvertent operation serves to break the connection which, for reasons previously explained, is preferable to having such operation make a connection. By arranging the switch to inhibit operation of the ratchet a push-push switch is capable of performing a momentary off function. In like fashion, arranging the contact to bridge the conductors under influence of the plunger, against action of the spring, enables essentially the same switch to execute a momentary on function.

BRIEF DESCRIPTION OF THE DRAWINGS

A preferred embodiment of the present invention will now be described in more detail in the following portions of this specification when taken in conjunction with the attached drawings in which like reference characters identify identical apparatus and in which:

FIG. 5 is a section similar to FIG. 4 showing, however, a modified version of the switch; and, FIG. 6 illustrates the switch with connectors on the conductors, external to the switch housing.

DETAILED DESCRIPTION OF PREFERRED EMBODIMENTS

Figure 1:
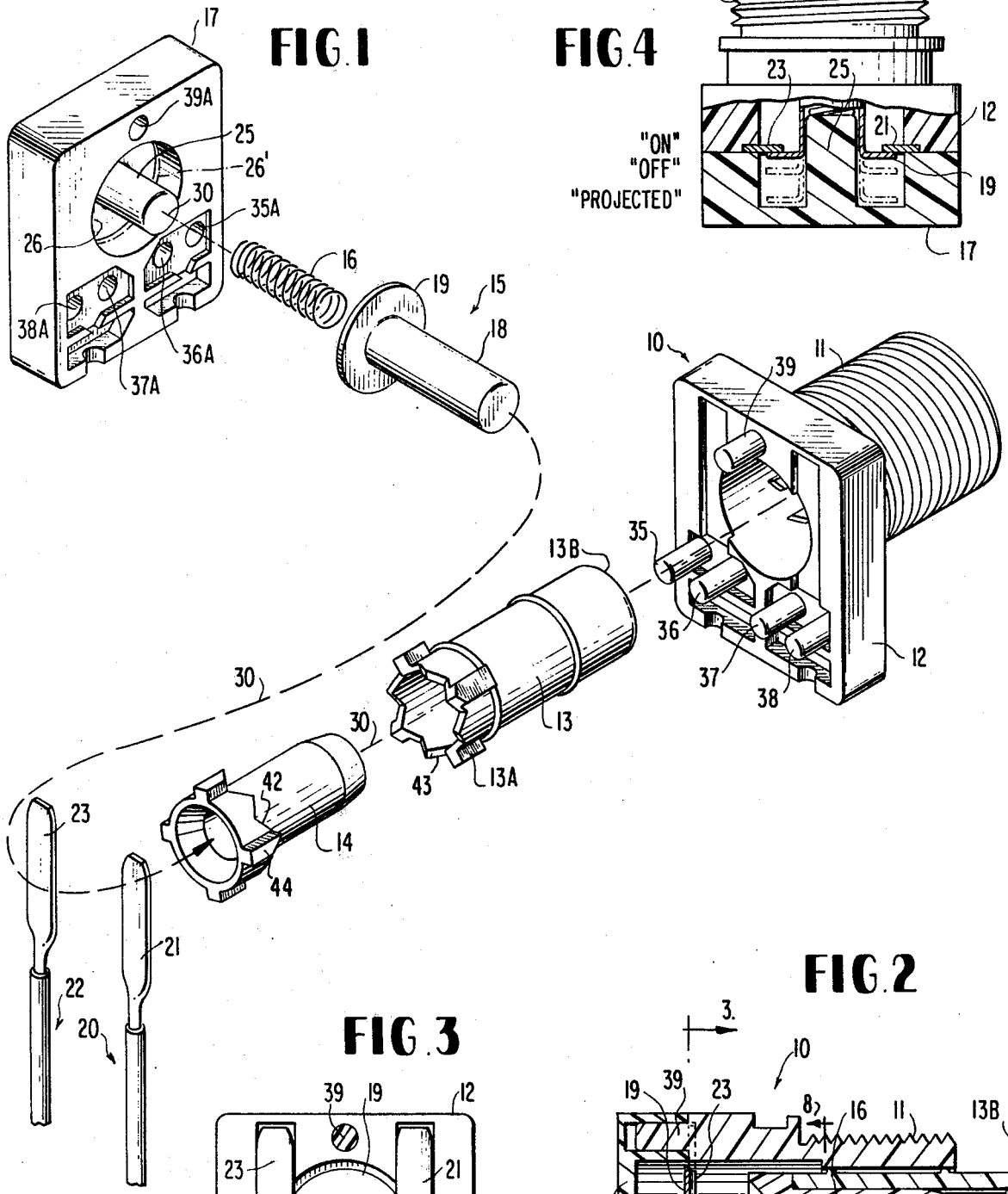
FIG. 1 is an exploded view of the inventive switch.

FIG. 1 is an exploded view of the several components of a switch embodying the present invention. More particularly, the switch comprises a housing 10 including an externally threaded barrel 11 having an axis 30 and a head portion 12 which is generally transverse to the axis 30. The head portion includes a plurality of pins 35–39, whose purpose will be discussed hereinafter. A generally cylindrical plunger 13 is arranged for sliding movement within the barrel 11 along the axis 30 with one end 13B available for manual (or other external force) projection along the axis 30. Fitted within the plunger 13 is a generally cylindrical sleeve 14 also aligned on axis 30 and arranged, by apparatus to be described, for motion longitudinal of the axis 30 and further arranged for rotational movement about the axis 30. A contact 15 is arranged to fit within the cylindrical sleeve 14 for motion along the axis 30. The contact 15 comprises a thimble-like contact having a generally cylindrical portion 18 and an annular flange 19 at one end thereof. A coil spring 16 is arranged to fit within the cylindrical portion 18 of the contact 15 and to bear against the contact 15 and a guide stud 25. The guide stud 25 comprises a portion of a cover 17 and serves to partially define an annular recess 26 in the cover 17. Additional recesses 35A–39A are included in the cover 17 for mating with the pins 35–39 of the head 12. The interference fit between the pins 35–39 and the recesses 35A–39A secure the cover 17 to the head 12 when the switch is assembled as well as locating the cover 17 properly with respect to the head 12.

The function of the switch is to selectively make or break an electrical connection between a pair of conductors, such as conductors 20 and 22. To this end, each of the conductors 20 and 22 is provided with a coined end 21 and 23, respectively. The coined ends of the conductors are located so that the shoulders are located by a pair of the pins such as 35–36 or 37–38 to properly locate the conductors 20 and 22 within the switch 10 (see in this regard FIG. 3). To make the electrical connection the flange 19 of the contact 15 bridges the coined ends 21, 23. Of course, at least the flange 19 (and preferably the entire contact 15) is formed of a conducting material.

Figure 4:
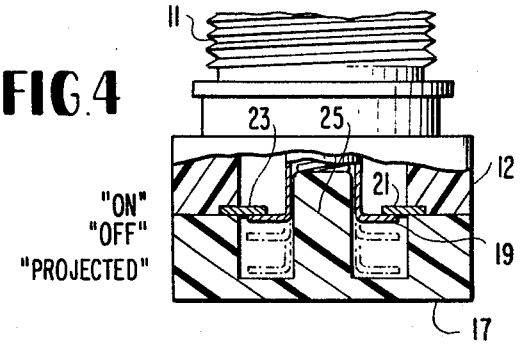
FIG. 4 is a section of the switch taken on the lines 4—4.
Figure 3:
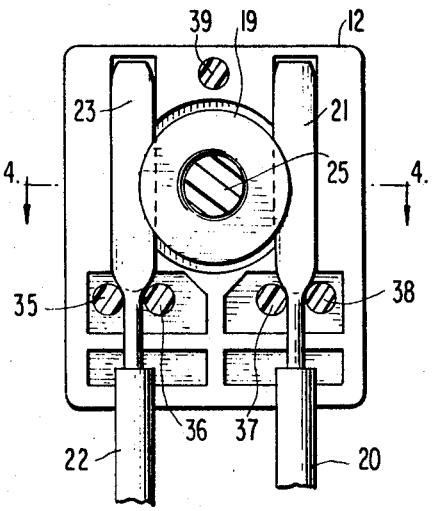
FIG. 3 is a cross-section taken on the lines 3—3.
Figure 2:
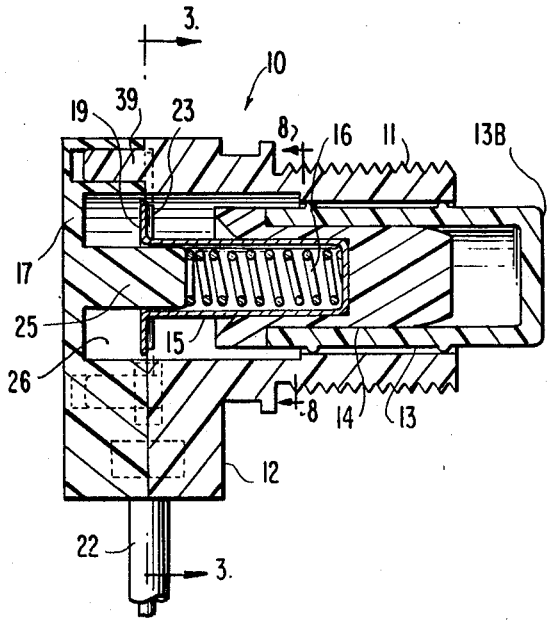
FIG. 2 is a cross-section of the switch taken through an axis thereof.

FIG. 2 is a cross-section of the switch in the closed condition, and FIG. 3 is a section taken on the lines 3—3. FIG. 4 illustrates still a different section of the switch taken on the lines 4—4. FIG. 4 illustrates the switch in the closed condition, wherein the flange 19 of the contact 15 bridges the coined ends 21 and 23 of the conductors 20 and 22 to establish an electrical connection. The legend "ON" indicates that when the flanged end 19 is in the condition shown, the switch is "ON." The adjacent dotted showing of flange 19, corresponding to the "OFF" legend, indicates that this is a second position of contact 15 wherein the switch is in the "OFF" condition. Finally, a second dotted showing of flange 19, associated with the legend "PROJECTED" indicates that as the plunger 13 is depressed, the flange 19 reaches the position shown. Actually, the contact 15 has two stable positions, the "ON" and "OFF" positions. The first of these positions is achieved through the action of the coil spring 16 biasing contact 15 against the stud 25. This biasing force establishes a solid electrical connection between the flange 19 and the coined ends of conductors 21 and 23. The second stable condition of the switch is achieved through the operation of a ratchet mechanism to be described hereinafter.

As shown in FIG. 1, plunger 13 carries a plurality of lugs 13A (as shown in FIG. 1, four lugs are provided). Corresponding extended recesses or ways are provided in the interior of the barrel 11 to allow the plunger 13 to move parallel to the axis 30, but the lugs prevent rotation of the plunger 13. Furthermore, the projecting end of the plunger 13 includes a plurality of spear pointed camming teeth 43. The sleeve 14, when telescoped into the bore of the plunger 13, has a plurality of rearwardly projecting camming teeth 42 which cooperate with the forwardly projecting camming teeth 43 on the plunger 13. In addition to the camming teeth of sleeve 14, the sleeve 14 also carries a plurality of latch dogs 44 projecting radially from alternate ones of the camming teeth, each of the dogs have a rear end of sawtooth form defining a camming ramp extending diagonally the full width of the dog. As shown in FIG. 1, a sleeve 14 carries four latch dogs 44 which engage alternately the four extended recesses or ways in barrel 11 and four partial recesses or ways which limit axial motion of sleeve 14 in an intermediate or off position and function as latching pockets.

In the retracted position of the sleeve 14, the latch dogs 44 are received in ways defined in the inner circumference of the barrel 11, these ways also serve to guide lugs 13A. At the forward or projecting end of the ways, diagonal shoulders define camming ramps. The outer diameter of the latch dogs on the sleeve 14 is greater than the inner diameter of shoulders in the camming ramps defined in the inner surface of the barrel 11. As a result, when the dogs of sleeve 14 are urged rearwardly by the coil spring 16, they engaged shoulders and camming action effects rotary indexing of the sleeve 14 to move the dogs into the latching pockets to establish a latched position of the switch. The dimensions of the ways and camming ramps associated with the outer surface of sleeve 14 establish the "OFF" position of the switch, in which the flange 19 achieves the "OFF" position illustrated in FIG. 4. A more complete description of the inter-action of the lugs, latch dogs and various camming surfaces of the plunger 13, sleeve 14 and barrel 11 is found in the referenced U.S. Pat. No. 3,694,603. While that patent accurately describes the operation of the aforementioned components which form a ratchet mechanism, which in certain rotary positions of sleeve 14 allow the flange 19 to be held in the "OFF" condition against the action of the spring 16, the remaining components of the switch, described here, have significant differences. Specifically, when the contact 15 is held by the ratchet mechanism in the projected position against action of the spring 16, the switch is open, in contrast to the teachings of U.S. Pat. No. 3,694,603 in which position the switch is closed. The washer 26′ (shown dotted in FIG. 1) is not used for the push-push embodiment of FIG. 4 may be used in the momentary off embodiment later described.

Figure 7:
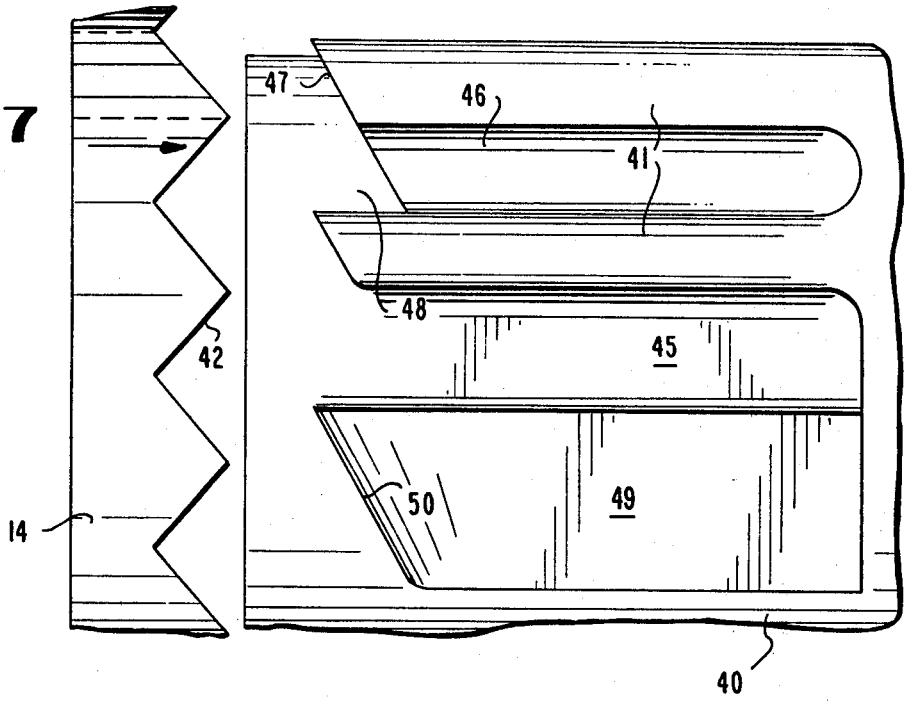
FIG. 7 is a developed view of the interior chamber of the barrel end ratchet assembly.
Figure 8:
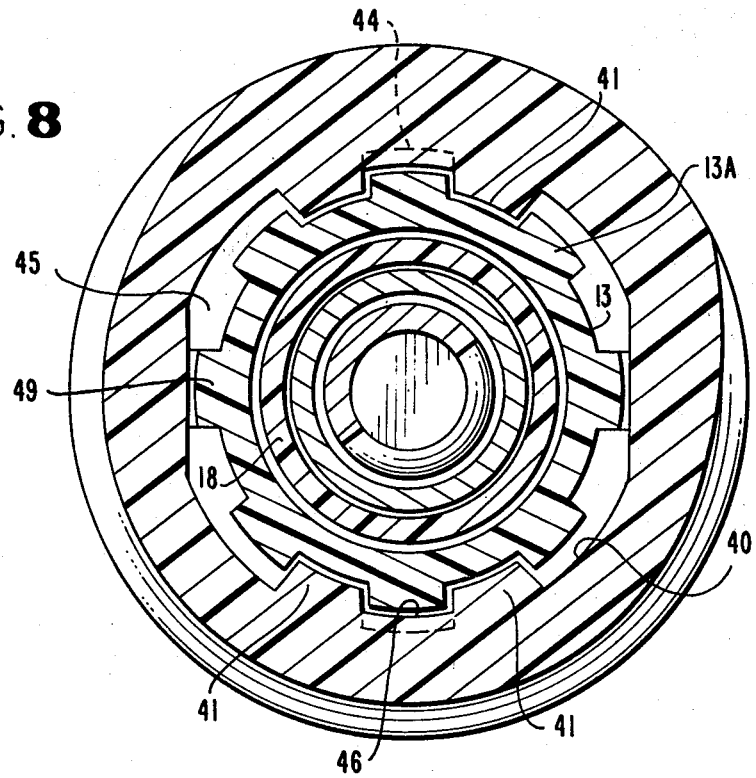
FIG. 8 is a cross-section view taken on the lines 8—8 of FIG. 2.

More particularly, the ratchet mechanism includes plunger 13, sleeve 14, as well as a recess or ways in the inner surface of the barrel 11. FIG. 7 is a developed view of the interior chamber 40 of barrel and ratchet 11, and FIG. 8 is a cross-section of the barrel taken at line 8—8 of FIG. 2. The interior chamber 40 is internally splined as shown in FIGS. 7 and 8. The plunger 13 has lugs 13*a* which are slidably received between diametrically opposed pairs of circumferentially spaced ribs 41. Thus, plunger 13 is freely reciprocable but fixed against rotation.

Sleeve 14 is telescoped into plunger 13 with its rearwardly projecting camming teeth 42 in axially opposed relation to the camming teeth 43 of the plunger 13. The cooperation of the camming teeth 42 and 43 produce rotary indexing of sleeve 14 when it is released for such rotation by being projected. Latch dogs 44 are received in ways 45 defined alongside the ribs 41. The ways 45 are deeper (that is, of greater radius from the axis 30) than the spaces between the ribs 41, such spaces are made more shallow by webs 46 between the splines. At the forward end, the ribs 24 and webs 46 have diagonal shoulders 47 defining camming ramps extending from one rib 41 to the adjacent rib of the pair to define a camming pocket 48. The outer diameter of the latch dogs 44 are greater than the inner diameter of the shoulders 47. Dogs 44, when urged rearwardly by the spring 16, will engage shoulders 47 with a camming action to effect rotary indexing of the sleeve 14 to move dogs 44 into pockets 48 to establish a latched position of the switch. In between pairs of ribs 41 are flat lands 49 with diagonal forward ends defining camming ramps 50 which may assist indexing to latched positions by engagement with dogs 41 alternate to those in latching position.

In a preferred embodiment of the invention each of the switch components comprising the barrel and head 11 and 12, plunger 13, sleeve 14, a cover 17 can be inexpensively molded, preferably employing plastic material. Although this is preferred from the standpoint of cost and ease of construction, those skilled in the art will understand that other materials, and other fabrication methods, could be employed as well. It is essential, of course, that if any portions of the head 12 or cover 17 are formed of a conducting material, insulation must be provided to prevent electrical connection between the coined ends 21 and 23. As shown in the drawings, the barrel 11 has an external thread which facilitates mechanical mounting of the switch in a manner which is adequately set forth in the referred-to patent.

In operation, when the switch is mechanically mounted in the desired position and the conductors 20 and 22 are attached to an electrical device which is controlled by the switch, the following operation can be achieved. To begin this description we will assume that the sleeve 14 is rotated to a position which will allow sleeve 14, plunger 13 and contact 15 to be urged to the retracted position under the force exerted by the spring 16. In this condition, electrical connection is made between the coined ends 21 and 23. To now operate the switch, the plunger 13 is projected, such as by manual force, compressing spring 16 and projecting the sleeve 14. This operation, at the same time, projects the contact 15 so that the previously closed circuit is now opened. As the manually exerted force is now removed, the plunger 13, sleeve 14 and contact 15 are again urged to the retracted position by the spring 16. However, as the sleeve 14 travels to the retracted position, the camming action of the ratchet mechanism rotates the sleeve 14 so that the latchdogs become trapped in the latching pockets against the action of the spring 16. This maintains the flange 19 in the position of FIG. 4 associated with the "OFF" legend. This corresponds to the switch being open. Subsequent manual actuation of the plunger 13 results in similar operation, although rotary indexing of the sleeve 14 results in the latchdogs being removed from the latch pockets and thus allows the contact 15 to be retracted under the force exerted by the spring 16 to the solid condition shown in FIG. 4, at which time the flange 19 bridges the coined ends 21 and 23. Thus, successive manual operations of the plunger 13 enable the switch to change from the closed to the open condition. In the switch field this is termed a push-push function.

In another embodiment of the invention, the switch function is of the "momentary off" type. In this embodiment, the contact 15 has only a single stable position, the "ON" condition. Projection of the plunger results in projection of the flange 19 to remove the bridging of coined ends 21 and 23, but only for so long as the plunger 13 remains projected. As soon as the projecting force is removed from the plunger 13, the flange 19 returns to the solid line illustration in FIG. 4, again bridging the conductors 21 and 23. For this type of operation, rotary indexing of the sleeve 14 is to be prevented, to thus prevent the latch dogs from being trapped in the latch pockets restraining the sleeve against the action of the spring 16. This can be simply effected by, for instance limiting projected travel of contact 15 in cavity 26 of cover 17, by a washer or similar device. A suitable washer 26' is shown dotted in FIG. 1. Alternatively, the sleeve 14 can be omitted and plunger 13 increased in length with omission of camming teeth. Other modifications that can be employed to prevent a ratcheting operation will occur to those skilled in the art. Regardless of the manner in which it is effected, when rotary indexing of sleeve 14 is prevented, the switch will have only the single stable "ON" condition in which the flange 19 bridges the conductors 21 and 23. This condition will be maintained in the absence of a force exerted on the plunger 13 projecting the same. The switch will be in the "OFF" or open condition only for so long, as the force remains to maintain the plunger 13 in a projected condition.

Still another variation of the switch enables the switch to perform the "momentary on" function. To effect this, the switch is modified such that the flange 19 does not contact the coined ends 21 and 23 as shown in FIG. 4, but rather can only contact them as shown in FIG. 5. In this configuration, flange 19 has an "OFF" position in which the contact 15 is held off the coined ends 21 and 23 through the force exerted by the coil spring 16. Depression of the plunger can, however, displace the flange 19 to the dotted line position shown in FIG. 5 (the "ON" position) in which case it bridges the coined ends 21 and 23 to establish an electrical connection. Thus, the switch will only be "ON" so long as the plunger 13 is projected by some external force. For this configuration of the switch, of course, the assembly must be varied slightly inasmuch as the flange 19 of the contact 15 is on the opposite side of the coined ends 21 and 23 as compared with the assembly required to produce the switch configuration shown in FIG. 4. Furthermore, in order to prevent rotary indexing which is, of course, unnecessary, the sleeve 14 may be eliminated and plunger 13 modified as before mentioned.

It will thus be seen that with slight modifications, the switch of the invention can alternatively perform a push-push, momentary off, or momentary on function, which greatly increases the versatility of the switch and enlarges its field of application. Furthermore, those skilled in the art will recognize the advantages to be gained by the switch in the push-push and momentary off configurations in which positive electrical contact is made between the flange 19 and the coined ends 21 and 23 by reason of the bias exerted by the coil spring 16.

While one of the advantages of the invention is the elimination of electrical connections, internal to the switch, it is within the spirit and scope of my invention to provide the switch with electrical conductors, as illustrated, which may also, however, include connectors external to the switch. For example, FIG. 6 illustrates the switch of my invention employing conductors 20 and 22 having external spade connectors for ready connection to an electrical circuit. More specifically, FIG. 6 is an isometric view of an assembled switch of the invention illustrating that the conductors 20 and 22, external of the switch, have spade connectors 29 mounted thereon. Obviously, many other types of electrical connectors could be employed, external to the switch, within the spirit and scope of the invention.

Many modifications can be made to the preferred embodiments illustrated herein, which modifications will be obvious to those skilled in the art after reviewing this description. For example, while the plug and recess configuration illustrated herein has actually been employed in examples of switches that have been manufactured, it may well be preferable to add additional plugs and recesses, for example, at the corners of head 12 and cover 17. While the barrel 11 is illustrated as carrying external threads, which facilitates mechanical mounting of the switch, those skilled in the art will realize that this feature, for example, is not essential to the invention. In view of the foregoing the scope of the invention is to be defined by the claims appended hereto and not by the preferred embodiments discussed herein.

I claim:

1. A pushbutton switch for electrically connecting a pair of conductors, each having coined ends retained in said switch, said switch comprising:

a housing including a barrel with an axis and head portion generally transverse to said axis, a cover secured to said head with said coined conductor ends secured, in electrically non-contacting relation, between said head and cover, said head and cover including insulating means to prevent an electrical connection between said conductors through either said head or said cover, a contact moveable along said axis for bridging said coined ends for electrically connecting said conductors, means mounting said contact for said axial movement to establish an electrical connection, a plunger axially slidable in said barrel and engaging said mounting for projecting said mounting means in an axial direction, biasing means yieldably biasing said contact, mounting means and plunger for return to a retracted position in which said contact bridges said conductors, a ratchet mechanism on said housing and mounting means for retaining said mounting means in a projected position against the bias of said biasing means, said plunger transmitting axial motion to said mounting means on a first stroke for operating said ratchet mechanism to retain said mounting means in a projected position at the conclusion of said stroke in which position said contact is out of engagement with said coined ends, said plunger transmitting axial motion to said mounting means on a second stroke for operating said ratchet mechanism to allow said biasing means to return said contact and mounting means to a retracted position, in which position said contact is in engagement with said coined ends.

2. The switch of claim 1 comprising a momentary off switch which further includes:

means for preventing operation of said ratchet mechanism whereby said contact normally bridges said conductors and axial motion of said plunger opens said electrical connection only for so long as said plunger is projected.

3. The switch of claim 2 in which:

said moveable contact comprises a thimble-like contact having a cylindrical portion and at one end thereof an annular flange for contacting the coined ends of said conductors, said cover includes a guide stud aligned with said axis.

said yieldable biasing means includes a coil spring mounted in said cylindrical portion and bearing against said guide stud, and said means preventing operation of said ratchet mechanism includes a washer mounted in said cover about said guide stud.

4. The switch of claim 1 in which said moveable contact comprises a thimble-like contact having a cylindrical portion and at one end thereof an annular flange for contacting the coined ends of said conductors.

5. The switch of claim 4 in which said biasing means includes a coil spring located within said cylindrical portion and biasing said contact against a cylindrical stud comprising a portion of said cover and aligned with said axis.

6. The switch of claim 4 in which said cover includes:

an annular recess aligned with said axis for receiving said annular flange, and a cylindrical stud located in said recess and aligned with said axis.

7. The switch of claim 6 in which said biasing means comprises a coil spring located between said guide stud at least partially within said cylindrical portion.

8. The apparatus of claim 1 in which said head portion of said housing and said cover includes at least a pair of pins and corresponding recesses, said pins and recesses formed to exhibit an interference fit, whereby inserting pins into corresponding recesses secures said head to said cover.

9. The apparatus of claim 8 in which head portion includes at least a pair of pins for each said conductor and said cover includes a recess corresponding to each of said pins.

10. The apparatus of claim 1 wherein said head portion includes at least a pair of pins for each said conductor, coined ends of said conductors having shoulders fixed between a corresponding pair of pins.

* * * * *